US009139327B2

(12) United States Patent
Lewis et al.

(10) Patent No.: US 9,139,327 B2
(45) **Date of Patent: *Sep. 22, 2015**

(54) PLASTIC CONTAINER HAVING TAPERED VACUUM PANELS

(75) Inventors: Benton A. Lewis, Manchester, PA (US); Justin A. Howell, New Cumberland, PA (US); Sunil S. Shah, York, PA (US); Michael T. Kelly, Manchester, PA (US); Robert Waltemyer, Felton, PA (US)

(73) Assignee: GRAHAM PACKAGING COMPANY, L.P., York, PA (US)

( * ) Notice: Subject to any disclaimer, the term of this patent is extended or adjusted under 35 U.S.C. 154(b) by 656 days.

This patent is subject to a terminal disclaimer.

(21) Appl. No.: 12/512,334

(22) Filed: Jul. 30, 2009

(65) Prior Publication Data

US 2011/0024385 A1 Feb. 3, 2011

(51) Int. Cl.

| | |
|---|---|
| ***B65D 1/02*** | (2006.01) |
| ***B65D 23/10*** | (2006.01) |
| ***B65D 79/00*** | (2006.01) |

(52) U.S. Cl.

CPC ..... *B65D 1/0276* (2013.01); *B65D 23/102* (2013.01); *B65D 79/005* (2013.01)

(58) Field of Classification Search

CPC ..... B65D 1/0223; B65D 79/005; B65D 2501/0036; B65D 2501/0081; B65D 2501/0027

USPC ..... 215/379, 384

See application file for complete search history.

(56) References Cited

U.S. PATENT DOCUMENTS

| | | | | | |
|---|---|---|---|---|---|
| D199,279 | S | * | 9/1964 | Koenigsberg | D9/529 |
| D252,672 | S | * | 8/1979 | Aldrich, III | D9/542 |
| D263,120 | S | * | 2/1982 | Fossella et al. | D9/550 |
| 5,141,121 | A | | 8/1992 | Brown et al. | |
| 5,303,834 | A | * | 4/1994 | Krishnakumar et al. | 215/381 |
| 5,971,184 | A | | 10/1999 | Krishnakumar et al. | |
| 6,439,413 | B1 | * | 8/2002 | Prevot et al. | 215/381 |

(Continued)

FOREIGN PATENT DOCUMENTS

WO 2006/039523 A1 4/2006

*Primary Examiner* — Fenn Mathew
*Assistant Examiner* — Cynthia Collado
(74) *Attorney, Agent, or Firm* — Baker Botts L.L.P.

(57) ABSTRACT

A plastic container that is adapted for adjustment to internal volumetric changes includes a container body defining an internal space and having a main body portion that defines a longitudinal axis and an outer diameter. The main body portion is substantially cylindrical at its outer diameter, and includes first and second recessed flexible vacuum uptake panels, each of which is constructed and arranged to flex inwardly to provide vacuum uptake when a sufficient underpressure exists in the internal space relative to ambient external pressure. The main body portion further includes a front side defining a first curved sidewall portion between the first and second recessed panels and a rear side defining a second curved sidewall portion between the first and second recessed panels. The first curved sidewall portion has a length $L_1$ as viewed in horizontal cross-section that is less than a length $L_2$ of the second curved sidewall portion. Each of the recessed panels has an upper portion and a lower portion, and each recessed panel is tapered so that the upper portion is recessed with respect to the outer diameter to a greater extent than the lower portion is recessed with respect to the outer diameter. This optimizes the usable surface area of the vacuum panels and forms a tapered grip configuration that enhances grippability of the plastic container by consumers.

23 Claims, 6 Drawing Sheets

(56) References Cited

U.S. PATENT DOCUMENTS

| | | | | |
|---|---|---|---|---|
| 6,460,714 | B1 * | 10/2002 | Silvers et al. | 215/381 |
| 6,837,390 | B2 * | 1/2005 | Lane et al. | 215/381 |
| 6,935,525 | B2 | 8/2005 | Trude | |
| 7,014,056 | B2 | 3/2006 | Trude | |
| 7,073,675 | B2 | 7/2006 | Trude | |
| 7,137,520 | B1 * | 11/2006 | Melrose | 215/381 |
| D538,168 | S * | 3/2007 | Davis et al. | D9/538 |
| 7,191,910 | B2 * | 3/2007 | Deemer et al. | 215/381 |
| D542,666 | S | 5/2007 | Trude | |
| D612,250 | S * | 3/2010 | Shah | D9/538 |
| 2006/0157439 | A1 | 7/2006 | Howell | |
| 2007/0075032 | A1 | 4/2007 | Kelley et al. | |
| 2007/0090083 | A1 | 4/2007 | Trude | |
| 2007/0125743 | A1 | 6/2007 | Pritchett, Jr. et al. | |
| 2007/0257004 | A1 | 11/2007 | Howell et al. | |
| 2011/0011825 | A1 * | 1/2011 | Howell et al. | 215/381 |

* cited by examiner

PLASTIC CONTAINER HAVING TAPERED VACUUM PANELS

BACKGROUND OF THE INVENTION

1. Field of the Invention

This invention relates generally to the field of plastic containers, and more particularly to plastic containers that are designed to accommodate volumetric expansion and contraction such as that inherent to the hot-fill packaging process or to packaging applications where internal pressurization is anticipated.

2. Description of the Related Technology

Many products that were previously packaged using glass containers are now being supplied in plastic containers, such as containers that are fabricated from polyesters such as polyethylene terephthalate (PET).

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies upon contacting the cooler surface of the mold, and the finished hollow container is subsequently ejected from the mold.

Hot fill containers are designed to be used with the conventional hot fill process in which a liquid product such as fruit juice is introduced into the container while warm or hot, as appropriate, for sanitary packaging of the product. After filling, such containers undergo significant volumetric shrinkage as a result of the cooling of the product within the sealed container. Hot fill type containers accordingly must be designed to have the capability of accommodating such shrinkage. Typically this has been done by incorporating one or more vacuum panels into the side wall of the container that are designed to flex inwardly as the volume of the product within the container decreases as a result of cooling.

Typically, the vacuum panel regions of conventional hot fill containers are characterized by having surfaces that are designed to deflect inwardly when the product within the sealed container undergoes shrinkage. In some instances, an inflexible island may be defined in the middle of the vacuum panel in order to provide support for an adhesive label that may be placed over the container. Grippability for the consumer is also an important consideration in the design of many containers. Condensation may form on the gripping surfaces of the container that has been removed from a refrigerator by a consumer, which makes it important to provide gripping surfaces that provides every possible mechanical advantage to consumers of all hand sizes when grasping the container.

The amount of volumetric contraction, also referred to as vacuum uptake, that can be provided by a conventional vacuum panel is limited by the size of the panel. The design of such containers is often influenced by the aesthetic preferences of manufacturers, which in some instances can limit the size of the vacuum panels to the extent that makes it difficult or impossible to achieve the necessary vacuum uptake capacity.

A need therefore exists for an improved vacuum panel configuration that achieves a maximal amount of vacuum uptake capacity, and that provides maximal mechanical advantage to the consumer when gripping the container.

SUMMARY OF THE INVENTION

It is therefore an object of the invention to provide an improved vacuum panel configuration that achieves a maximal amount of vacuum uptake capacity, and that provides maximal mechanical advantage to the consumer when gripping the container.

In order to achieve the above and other objects of the invention, a plastic container according to a first aspect of the invention includes a container body defining an internal space, the container body having a main body portion defining a longitudinal axis and an outer diameter. The main body portion is substantially round at the outer diameter and has defined therein at least one recessed panel that has an upper portion and a lower portion. The recessed panel is tapered so that the upper portion is recessed with respect to the outer diameter to a greater extent than the lower portion is recessed with respect to the outer diameter. As a result, grippability of said plastic container by a consumer is optimized.

A plastic container that is adapted for adjustment to internal volumetric changes according to a second aspect of the invention includes a container body defining an internal space. The container body has a main body portion defining a longitudinal axis and an outer diameter, and that is substantially cylindrical at the outer diameter. At least one recessed flexible vacuum uptake panel is defined in the main body portion that is constructed and arranged to flex inwardly to provide vacuum uptake when a sufficient underpressure exists in the internal space relative to ambient external pressure. The recessed panel has an upper portion and a lower portion, and is tapered so that the upper portion is recessed with respect to the outer diameter to a greater extent than the lower portion is recessed with respect to the outer diameter. Accordingly, grippability of the plastic container by a consumer is optimized.

According to a third aspect of the invention, a plastic container that is adapted for adjustment to internal volumetric changes includes a container body defining an internal space. The container body has a main body portion defining a longitudinal axis and an outer diameter, and is substantially cylindrical at the outer diameter. First and second recessed flexible vacuum uptake panels are defined in the main body portion, each of which is constructed and arranged to flex inwardly to provide vacuum uptake when a sufficient underpressure exists in the internal space relative to ambient external pressure. The main body portion further includes a front side defining a first curved sidewall portion between the first and second recessed panels and a rear side defining a second curved sidewall portion between the first and second recessed panels, the first curved sidewall portion having a length $L_1$ as viewed in horizontal cross-section that is less than a length $L_2$ of the second curved sidewall portion. Each of the recessed panels has an upper portion and a lower portion, and each of the recessed panels is tapered so that the upper portion is recessed with respect to the outer diameter to a greater extent than the lower portion is recessed with respect to the outer diameter. As a result, grippability of the plastic container by a consumer is optimized.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
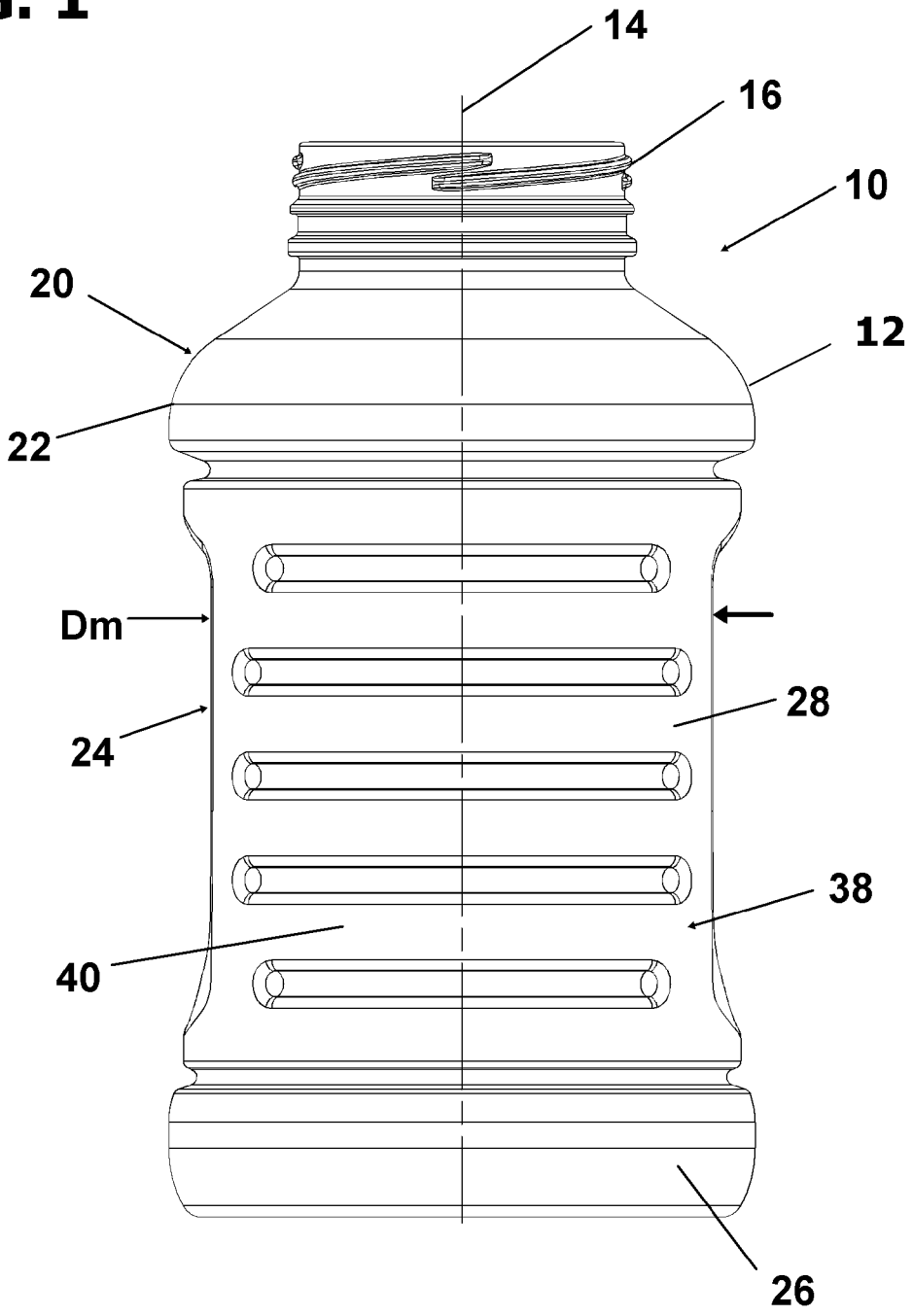
FIG. 1 is a rear elevational view of a container that is constructed according to a preferred embodiment of the invention.

Referring now to the drawings, wherein like reference numerals designate corresponding structure throughout the views, and referring in particular to FIG. 1, plastic container 10 that is constructed according to a first preferred embodiment of the invention is designed to accommodate volumetric expansion and contraction such as that which is inherent to the hot-fill packaging process or to packaging applications where internal pressurization is anticipated.

Container 10 includes a container body 12, which is preferably fabricated out of a material such as polyethylene terephthalate (PET) using a conventional stretch blow molding process. Container body 12 defines a longitudinal axis 14 and preferably includes a threaded finish portion 16 that defines an opening that is in communication with an internal space 18 that is defined within the container body 12. Finish portion 16 is adapted to receive a conventional closure (not shown) in order to seal the container 10 after filling by the manufacturer and between uses by the consumer. Container body 12 further preferably includes a neck or shoulder portion 20 having a bell-shaped dome 22, a main body portion 24 and a bottom portion 26.

The container body 12 and in particular the main body portion 24 is molded so as to have a thin sidewall 28. The portion of the sidewall 28 that defines the main body portion 24 is shaped so that the outermost surfaces thereof are substantially cylindrical. The main body portion accordingly has an outer diameter $D_m$, and is shaped so as to be substantially round at the outer diameter. As may be seen in FIG. 2, the outer diameter $D_m$ of the main body portion 24 is preferably slightly less than the maximum outer diameter $D_{max}$ of the container 10, but it could alternatively be the same as or greater than the maximum outer diameter $D_{max}$ of the container 10. Additionally, the outer diameter $D_m$ is preferably greater than the diameter $D_f$ of the finish portion 16.

Figure 3:
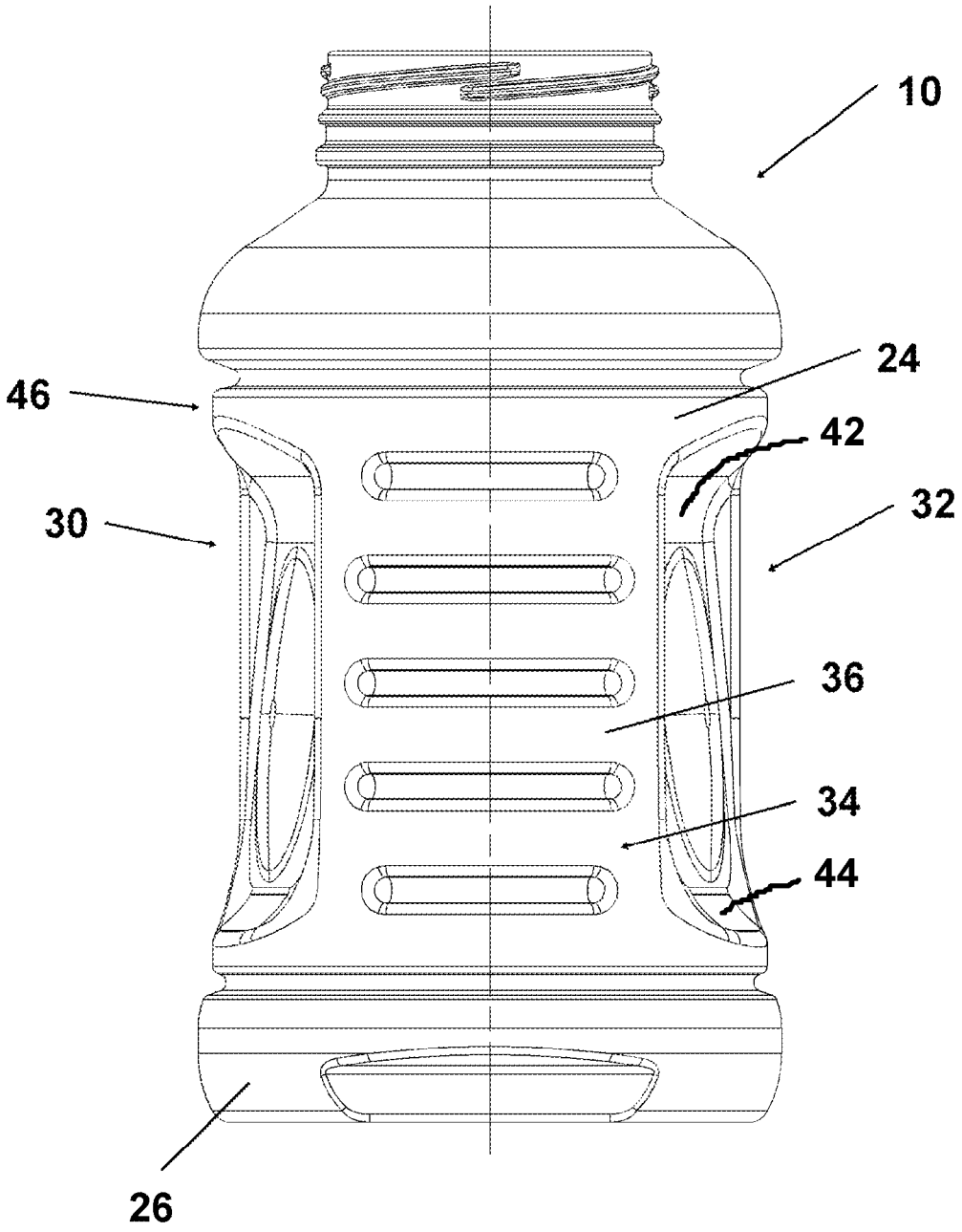
FIG. 3 is a front elevational view of the container shown in FIG. 1.
Figure 4:
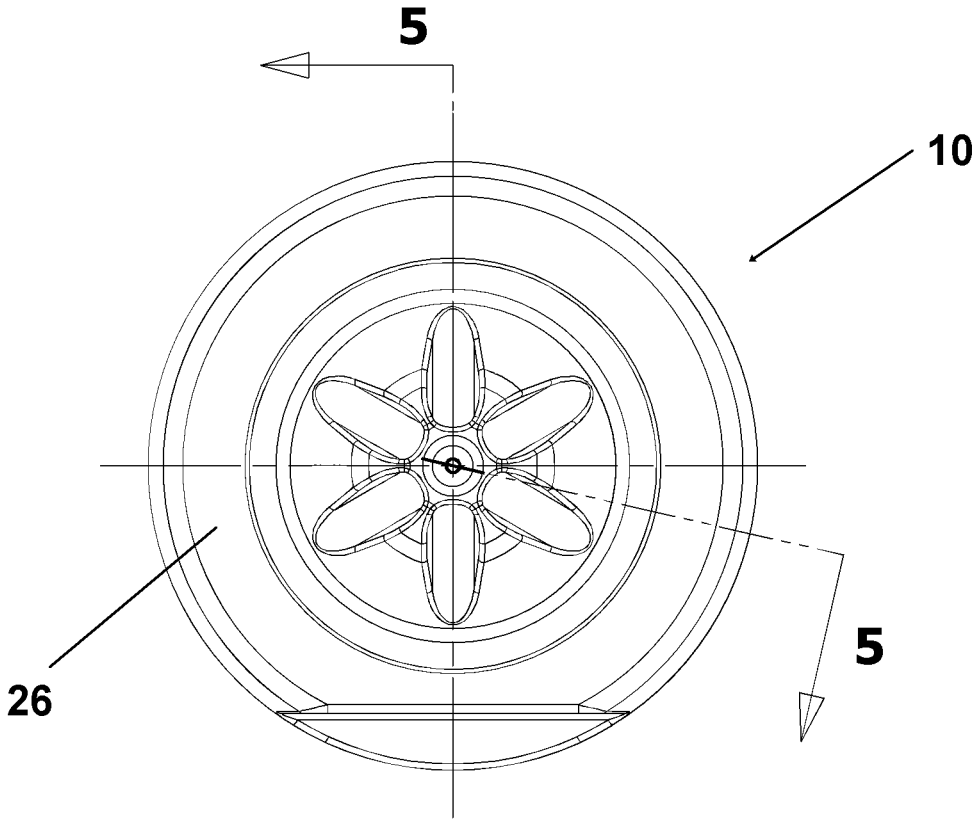
FIG. 4 is a bottom plan view of the container shown in FIG. 1.
Figure 5:
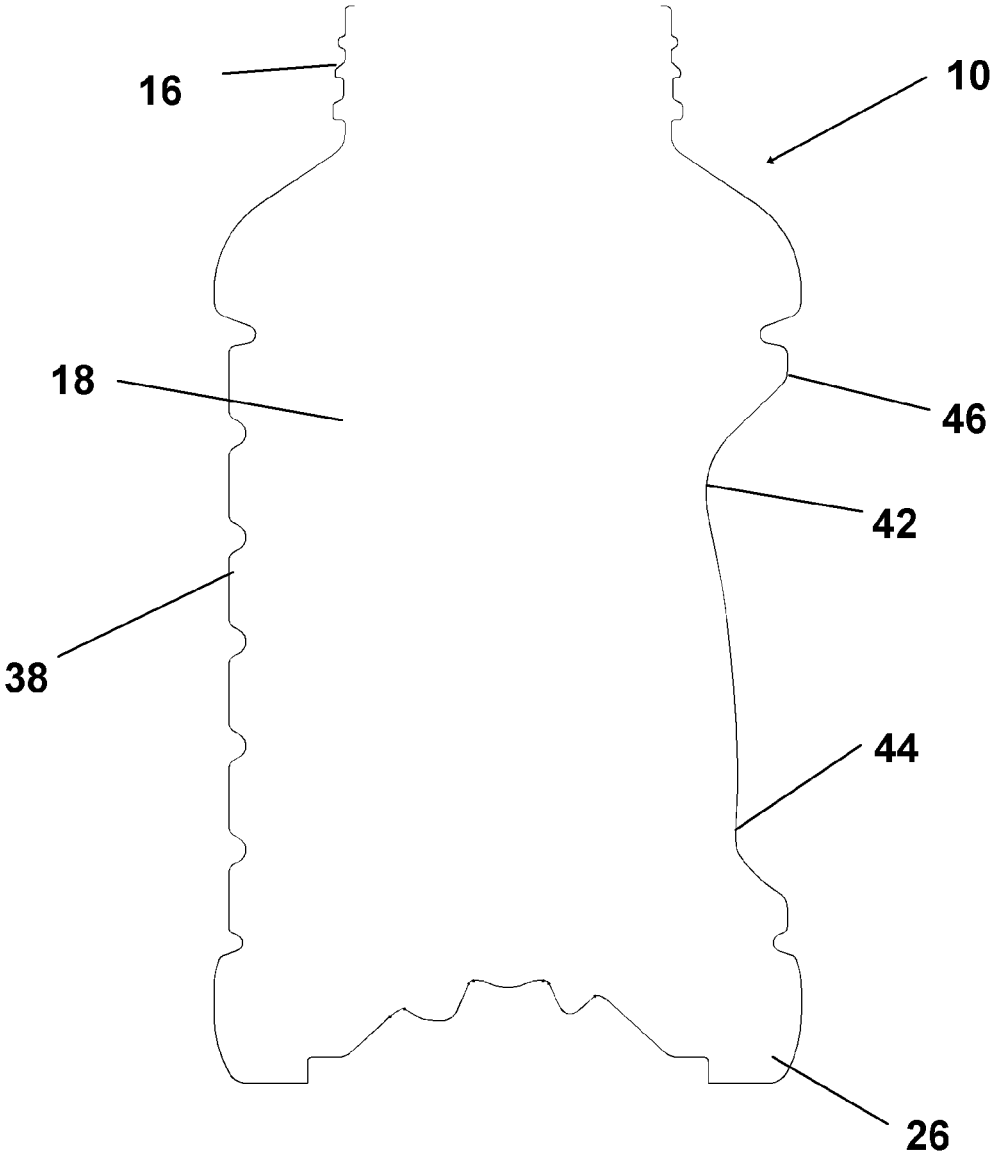
FIG. 5 is a cross-sectional view taken along lines 5-5 in FIG. 4.

Referring briefly to FIG. 3, first and second recessed flexible vacuum uptake panels 30, 32 are defined in the main body portion 24. Each of the vacuum panels 30, 32 is constructed and arranged to flex inwardly in order to provide vacuum uptake when a sufficient underpressure exists in said internal space relative to ambient external pressure.

Figure 6:
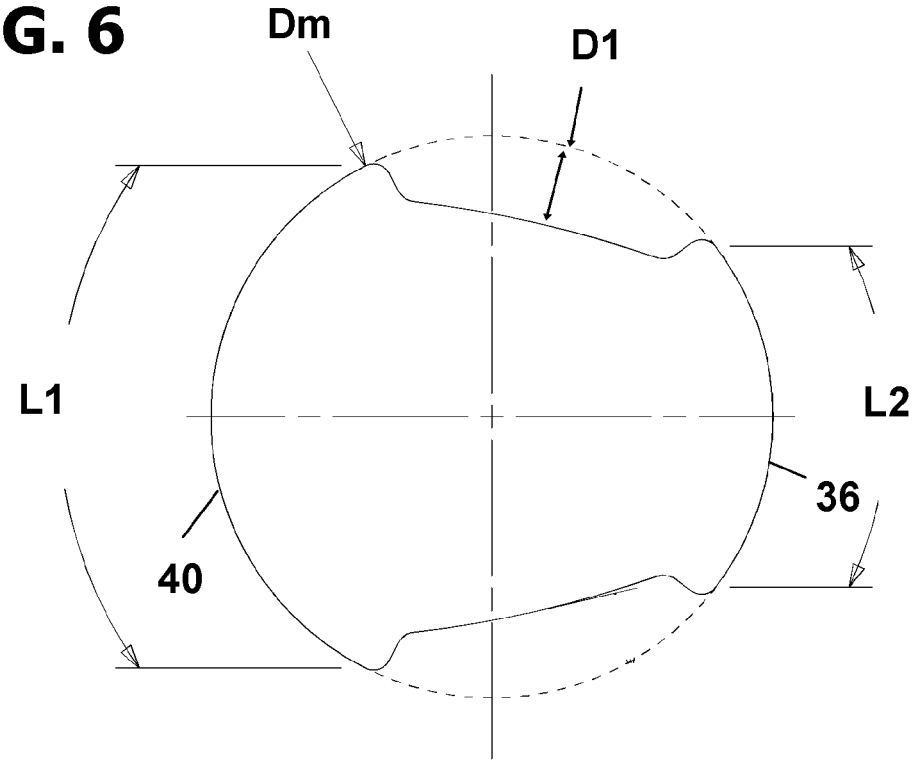
FIG. 6 is a cross-sectional view taken along lines 6-6 in FIG. 2.
Figure 7:
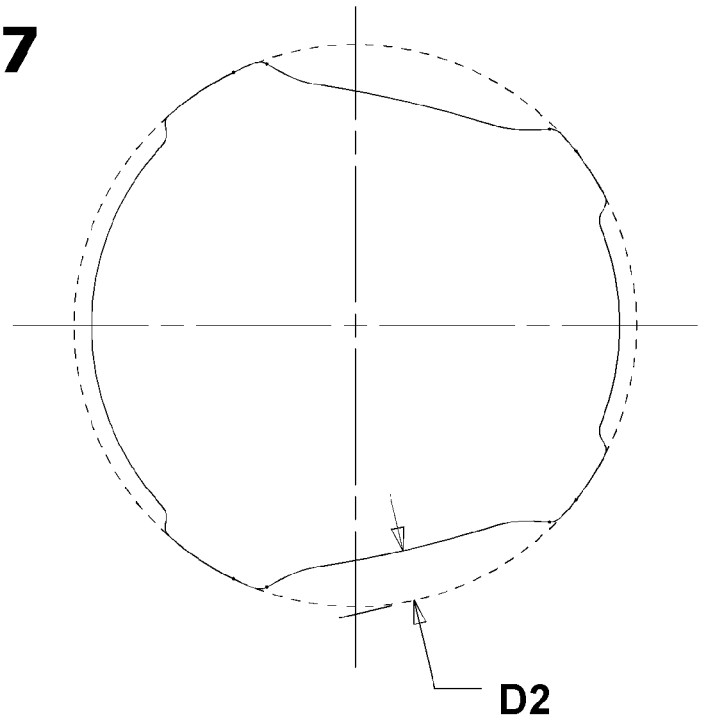
FIG. 7 is a cross-sectional view taken along lines 7-7 in FIG. 2.

The main body portion 24 further includes a front side 34, best shown in FIG. 3, that defines a first curved sidewall portion 36 between the first and second recessed panels 30, 32 and a rear side 38, best shown in FIG. 1, defining a second curved sidewall portion 40 that is also between the first and second recessed panels 30, 32 and opposed across the longitudinal axis 14 from the first curved sidewall portion 36. As is best shown in FIG. 6, the first curved sidewall portion 36 has a length $L_1$ as viewed in horizontal cross-section that is more than a length $L_2$ of the second curved sidewall portion 40. A ratio of the length $L_1$ of the first curved sidewall portion 36 to the length $L_2$ of the second curved sidewall portion is preferably within a range of about 1.4 to about 2.0.

Figure 2:
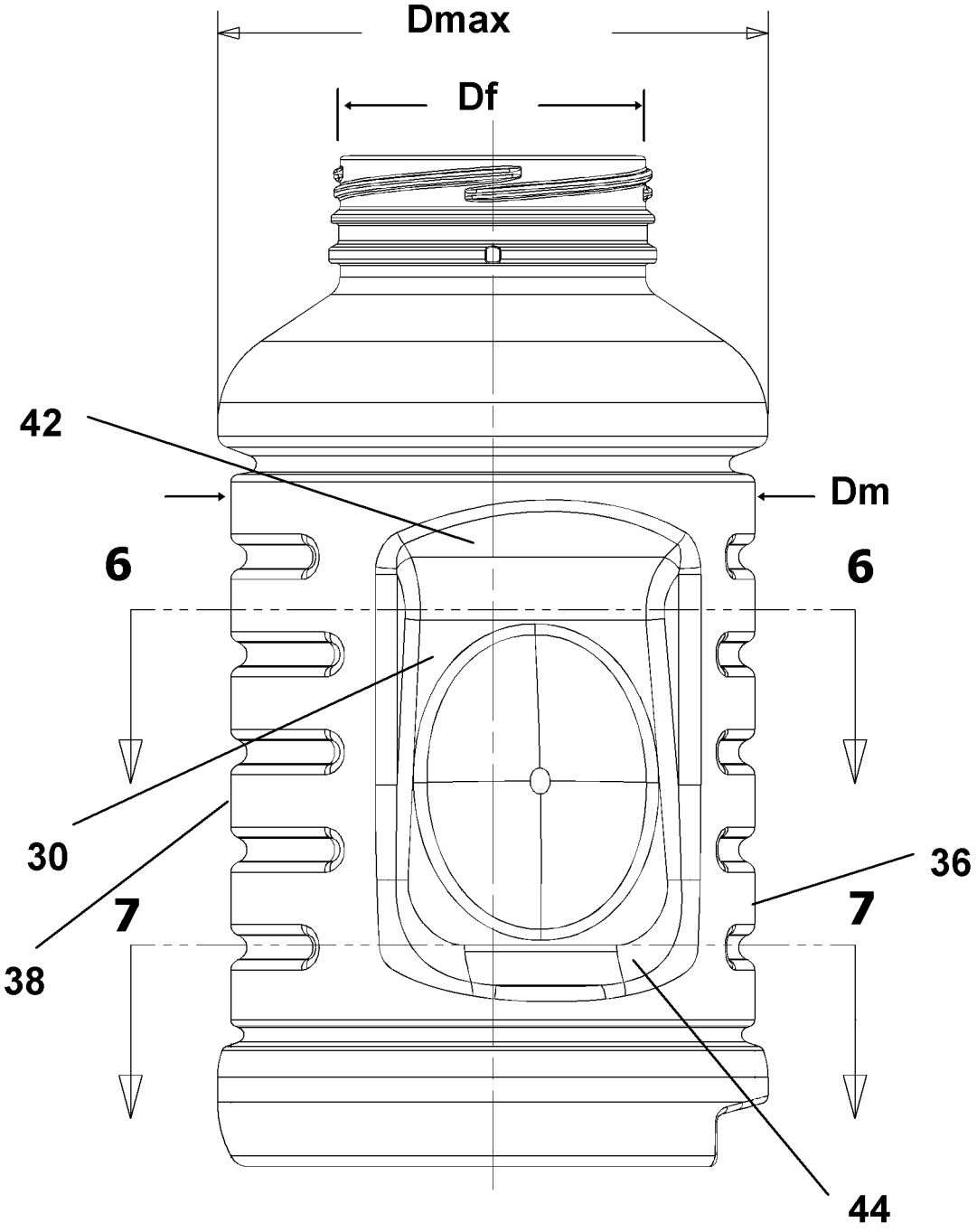
FIG. 2 is a side elevational view of the container shown in FIG. 1.

Referring now to FIGS. 2, 3 and 6, it will be seen that each of said recessed panels 30, 32 has an upper portion 42, a lower portion 44 and a central portion positioned between the upper and lower portions 42, 44. Each of the recessed panels 30, 32 is advantageously tapered so that the upper portion 42 is recessed with respect to the outer diameter $D_m$ of the main body portion 24 to a greater extent than the lower portion 44 is recessed with respect to the outer diameter $D_m$. In other words, the upper portion 42 is positioned closer to the longitudinal axis 14 than is the lower portion 44 when the container is not being squeezed by a consumer. This optimizes the usable surface area of the vacuum panels 30, 32 and forms a tapered grip configuration that enhances grippability of the plastic container by consumers.

Preferably, the main body portion 24 extends to said outer diameter $D_m$ at a location that is above the recessed panel 30, 32, so that grippability of the plastic container 10 by a consumer is optimized. Specifically, as may be visualized from FIG. 3, the deeper recess that exists near the top of the vacuum panels 30, 32 in close juxtaposition with the substantially wider uppermost portion 46 of the main body portion 24 in effect creates a ledge or hook against which the side of a consumer's index finger can rest or bear when gripping the container 10. This provides additional security against the container 10 slipping with respect to the consumer's hand in the direction of the longitudinal axis 14, which can be particularly helpful when the outer surface of the container 10 is slick from condensation or from other causes.

As is best shown in FIG. 6, the upper portion 42 of both panels 30, 32 is recessed with respect to the outer diameter $D_m$ by a first maximum depth $D_1$, and the lower portion 44 of both panels 30, 32 is recessed with respect to the outer diameter $D_m$ by a second maximum depth $D_2$. Preferably a ratio $D_1/D_2$ of the first maximum depth to the second maximum depth is within a range of about 1.1 to about 2.5. More preferably, the ratio $D_1/D_2$ of the first maximum depth to the second maximum depth is within a range of about 1.3 to about 1.9, and most preferably this ratio is within a range of about 1.5 to 1.7.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container, comprising:

a container body defining an internal space, said container body having a sidewall defining a longitudinal axis and further defining a main body portion having an outer diameter, said main body portion being substantially cylindrical at said outer diameter; and at least one recessed panel defined in said main body portion, said recessed panel having an upper portion, a lower portion and a central portion positioned between the upper and lower portions, and wherein said recessed panel is angled relative to the longitudinal axis with said upper portion recessed relative to the sidewall at the outer diameter to a greater extent than the lower portion is recessed relative to the sidewall at the outer diameter when the container body is in an as-formed condition.

2. A plastic container according to claim 1, further comprising a second recessed panel defined in said main body portion and angled relative to the longitudinal axis.

3. A plastic container according to claim 1, wherein said main body portion has an uppermost portion with said outer diameter above said recessed panel.

4. A plastic container according to claim 1, wherein said upper portion is recessed with respect to the sidewall at the outer diameter by a first maximum depth $D_1$, and wherein said lower portion is recessed with respect to the sidewall at the outer diameter by a second maximum depth $D_2$, and wherein a ratio $D_1/D_2$ of said first maximum depth to said second maximum depth is within a range of about 1.1 to about 2.5.

5. A plastic container according to claim 4, wherein said ratio $D_1/D_2$ of said first maximum depth to said second maximum depth is within a range of about 1.3 to about 1.9.

6. A plastic container according to claim 5, wherein said ratio $D_1/D_2$ of said first maximum depth to said second maximum depth is within a range of about 1.5 to about 1.7.

7. A plastic container according to claim 1, wherein said recessed panel is configured to flex inwardly to provide vacuum uptake when a sufficient underpressure exists in said internal space relative to ambient external pressure.

8. A plastic container according to claim 2, wherein said main body portion includes a front side defining a first curved portion between said first and second recessed panels; and a rear side defining a second curved portion between said first and second recessed panels; and wherein said first curved portion has a length $L_1$ as viewed in horizontal cross-section that is less than a length $L_2$ of said second curved portion.

9. A plastic container according to claim 8, wherein a ratio of said length $L_1$ of said first curved portion to said length $L_2$ of said second curved portion is within a range of about 1.4 to about 2.0.

10. A plastic container according to claim 1, wherein said container body is fabricated from a material comprising polyethylene terephthalate.

11. A plastic container that is adapted for adjustment to internal volumetric changes, comprising:

a container body defining an internal space, said container body having a sidewall defining a longitudinal axis and further defining a main body portion having an outer diameter, said main body portion being substantially cylindrical at said outer diameter; and at least one recessed flexible vacuum uptake panel defined in said main body portion that is configured to flex inwardly to provide vacuum uptake when a sufficient underpressure exists in said internal space relative to ambient external pressure, said recessed panel having an upper portion, a lower portion and a central portion positioned between the upper and lower portions, and wherein said recessed panel is angled relative to the longitudinal axis with said upper portion recessed relative to the sidewall at the outer diameter to a greater extent than the lower portion is recessed relative to the sidewall at the outer diameter when the container body is in an as-formed condition.

12. A plastic container according to claim 11, further comprising a second recessed panel defined in said main body portion and angled relative to the longitudinal axis.

13. A plastic container according to claim 11, wherein said main body portion has an uppermost portion with said outer diameter above said recessed panel.

14. A plastic container according to claim 11, wherein said upper portion is recessed with respect to the sidewall at the outer diameter by a first maximum depth $D_1$, and wherein said lower portion is recessed with respect to the sidewall at the outer diameter by a second maximum depth $D_2$, and wherein a ratio $D_1/D_2$ of said first maximum depth to said second maximum depth is within a range of about 1.1 to about 2.5.

15. A plastic container according to claim 14, wherein said ratio $D_1/D_2$ of said first maximum depth to said second maximum depth is within a range of about 1.3 to about 1.9.

16. A plastic container according to claim 15, wherein said ratio $D_1/D_2$ of said first maximum depth to said second maximum depth is within a range of about 1.5 to about 1.7.

17. A plastic container according to claim 12, wherein said main body portion includes a front side defining a first curved portion between said first and second recessed panels; and a rear side defining a second curved portion between said first and second recessed panels; and wherein said first curved portion has a length $L_1$ as viewed in horizontal cross-section that is more than a length $L_2$ of said second curved portion.

18. A plastic container according to claim 17, wherein a ratio of said length $L_1$ of said first curved portion to said length $L_2$ of said second curved portion is within a range of about 1.4 to about 2.0.

19. A plastic container according to claim 11, wherein said container body is fabricated from a material comprising polyethylene terephthalate.

20. A plastic container that is adapted for adjustment to internal volumetric changes, comprising:

a container body defining an internal space, said container body having a sidewall defining a longitudinal axis and further defining a main body portion having an outer diameter, said main body portion being substantially cylindrical at said outer diameter with a substantially circular cross-section in plan view;

first and second recessed flexible vacuum uptake panels defined in said main body portion, each of which is configured to flex inwardly to provide vacuum uptake when a sufficient underpressure exists in said internal space relative to ambient external pressure;

said main body portion further including a front side defining a first curved portion between said first and second recessed panels and a rear side defining a second curved portion between said first and second recessed panels, said first curved portion having a length $L_1$ as viewed in horizontal cross-section that is more than a length $L_2$ of said second curved portion; and wherein each of said recessed panels has an upper portion, a lower portion and a central portion positioned between the upper and lower portions, and wherein each of said recessed panels is angled relative to the longitudinal axis with said upper portion recessed relative to the sidewall at the outer diameter to a greater extent than the lower portion is recessed relative to the sidewall at the outer diameter when the container body is in an as-farmed condition.

21. A plastic container according to claim 3, wherein the uppermost portion is configured to provide a surface for finger engagement.

22. A plastic container according to claim 1, wherein the main body portion has a substantially circular cross-section in plan view.

23. A plastic container according to claim 20, wherein the first curved sidewall portion further comprises at least one horizontal rib defined therein.

* * * * *